US005381892A

United States Patent [19]

Allen

[11] Patent Number: 5,381,892

[45] Date of Patent: Jan. 17, 1995

[54] SUPPORT STRUCTURE FOR RETAINING ITEMS IN POSITION

[76] Inventor: William M. Allen, 204 Cayuga Rd., Louisville, Ky. 40207

[21] Appl. No.: 904,964

[22] Filed: Jun. 26, 1992

[51] Int. Cl.[6] ..... B65D 25/04

[52] U.S. Cl. ..... 206/216; 229/101; 229/120.09

[58] Field of Search ..... 206/216; 224/42.42; 229/101, 120.01, 120.011, 120.08, 120.09, 120.11, 120.18, 120.31, 120.37, 120.38

[56] References Cited

U.S. PATENT DOCUMENTS

| | | | |
|---|---|---|---|
| 1,221,884 | 4/1917 | Martin | 229/101 |
| 2,684,178 | 7/1954 | Keeler | 229/120.18 |
| 2,706,037 | 4/1955 | Feigelman | 229/120.09 |
| 3,044,211 | 7/1962 | Palm | 229/120.09 |
| 3,048,321 | 8/1962 | Sanford | 229/120.18 |
| 3,135,457 | 6/1964 | Risucci | 229/120.18 |
| 3,341,103 | 9/1967 | May | 229/120.18 |
| 3,677,458 | 7/1972 | Gosling | 229/120.011 |
| 3,785,545 | 1/1974 | Roussel | 229/120.09 |
| 4,756,469 | 7/1988 | Hansen | 229/120.31 |
| 4,913,291 | 4/1990 | Schuster | 229/120.11 |
| 4,951,867 | 8/1990 | McManus | 224/42.42 |

*Primary Examiner*—Jimmy G. Foster
*Attorney, Agent, or Firm*—Maurice L. Miller, Jr.

[57] ABSTRACT

A support structure for retaining items, such as pots of flowers, bottles, bags and the like in position includes a peripheral side wall having an open top and an open bottom defining at least two bag-containing compartments. The support structure is foldable from a folded, generally flat, storable configuration to an unfolded, in-use configuration.

10 Claims, 8 Drawing Sheets

SUPPORT STRUCTURE FOR RETAINING ITEMS IN POSITION

BACKGROUND OF THE INVENTION

The present invention relates to foldable support structures for holding items, such as pots of flowers, bottles and flexible bags in position therein.

The present invention is directed to an open top and open bottom support structure for retaining the contents thereof in location. The present invention is very useful for holding items such as pots of flowers and bottles in position and is particularly useful in holding already-filled bags in position therein. The support structure of the present invention finds particular utility in supporting such items as pots of flowers, bottles or filled grocery bags during transport in, for example, a car trunk. Transporting items such as filled grocery bags or pots of flowers in the trunk of a car, for example, presents the problem of the bags falling over spilling the contents. In transporting filled bottles, when the bottles fall over, they can roll around creating a problem particularly in the event the bottles are filled with a carbonated beverage. This is particularly true of the soft, thin film plastic grocery bags that are now so popular.

Bag supports and the like are, per se, known. Examples of such known bag supports are shown in the following patents.

U.S. Pat. No. 1,895,904 issued on Jan. 31, 1933 is directed to a rigid wire frame of a suitable size to be placed in a kitchen sink or drainboard for supporting having loops formed at the top ends of the upright members of the frame to engage the lip of the side walls of a paper to hold the empty bag upright and open while the bag is filled with garbage.

U.S. Pat. No. 2,600,4398 issued on Jun. 17, 1952 is directed to a rigid wire frame for holding a cloth laundry bag. The top ends of the upright members of the frame have hooks which are received in eyes formed in the walls of the laundry bag around the bag opening to hold the bag in place in the frame.

U.S. Pat. No. 2,669,351 issued on Feb. 16, 1954 is directed to a corrugated paper container having, for example, two compartments for containing pouches of liquid. The container has a peripheral side wall, a portion dividing the interior into compartments, a bottom wall and a top wall.

U.S. Pat. No. 3,539,360 issued on Nov. 10, 1970 is directed to a conventional fiberboard carton having side walls, bottom wall and closable top wall for holding a filled plastic bag therein. Adhesive is located on the carton side wall for securing the bag in the carton.

U.S. Pat. No. 4,280,676 issued on Jul. 28, 1981 is directed to a generally truncated, conically-shaped support constructed of a sheet of plastic for holding a flexible bag open to aid in filling the bag with, for example, garbage. The peripheral top lip surrounding the top opening of the support is formed with a peripheral downwardly facing hook member over which the open mouth of the bag is folded to engage the hook member.

U.S. Pat. No. 4,457,483 issued on Jul. 3, 1984 is directed to a cylindrically-shaped support fabricated of a sheet of plastic. The sheet of plastic material is held in cylindrical shape by means of knobs formed along one vertical edge of the plastic sheet which engage openings formed along the other vertical edge of the plastic sheet. Tabs receive the lip of a bag to hold the bag in the cylindrical support. To store the cylindrical support, the knobs are disengaged from the openings and the sheet of plastic is tightly rolled to form a cylinder of smaller circumference than it was in the bag-holding configuration.

U.S. Pat. No. 4,705,246 issued on Nov. 10, 1987 is directed to a framework structure for holding a bag open while it is filled with debris such as leaves or grass clippings. The framework is adapted to be laid on its side so that the bag held therein is also laid on its side in an open configuration so that leaves and the like can be swept into the bag.

The above-mentioned support structures have numerous drawbacks, which are solved by the present invention.

SUMMARY OF THE INVENTION

The present invention provides a straightforward support structure which is foldable between a storable flat configuration and an unfolded, in-use configuration.

The present invention provides a straightforward container or support construction which is relatively inexpensive to manufacture.

The present invention provides a support structure for restraining items in position therein comprises a peripheral side wall structure having an open top and an open bottom, and a partition disposed in the space defined by the peripheral side wall secured at its opposite ends the peripheral side walls, and dividing the space defined by the peripheral side wall into two item-receiving compartments.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENTS

Figure 1:
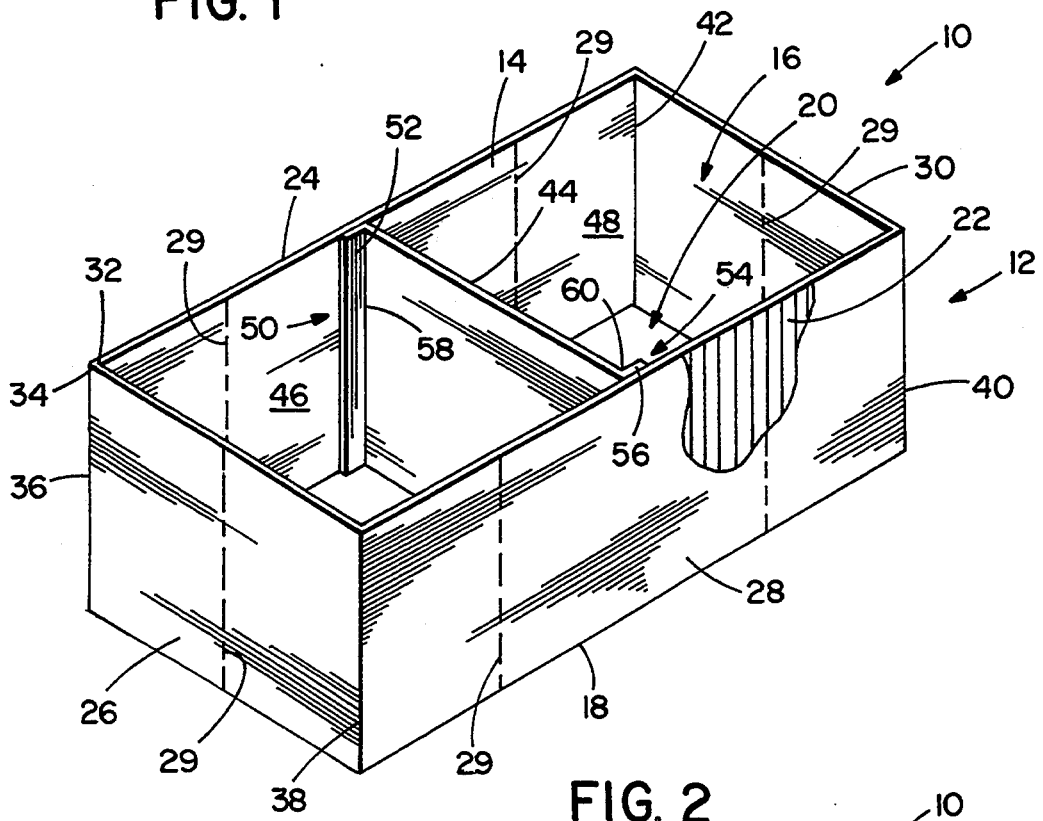
FIG. 1 is a perspective view of one embodiment of a support structure of the present invention in an unfolded in-use configuration.
Figure 2:
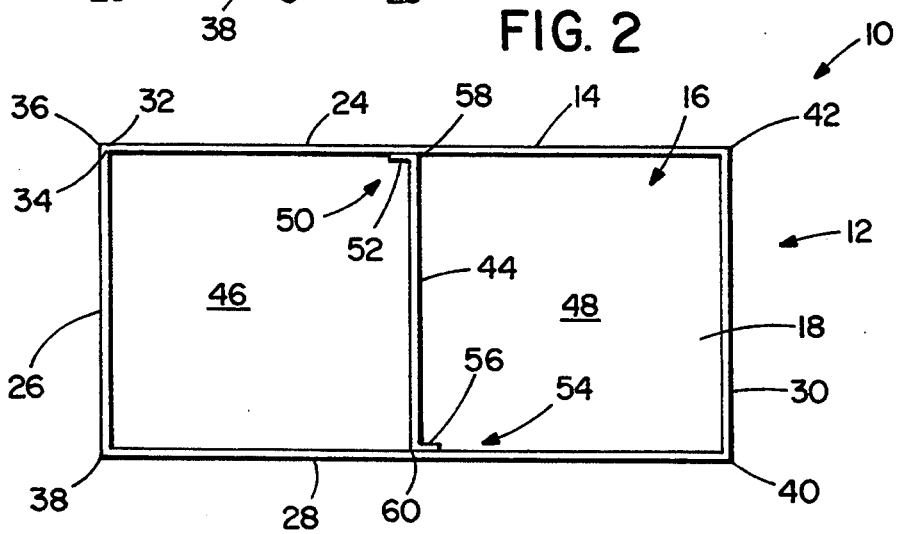
FIG. 2 is a top view of the support structure of the support structure of FIG. 1.
Figure 3:
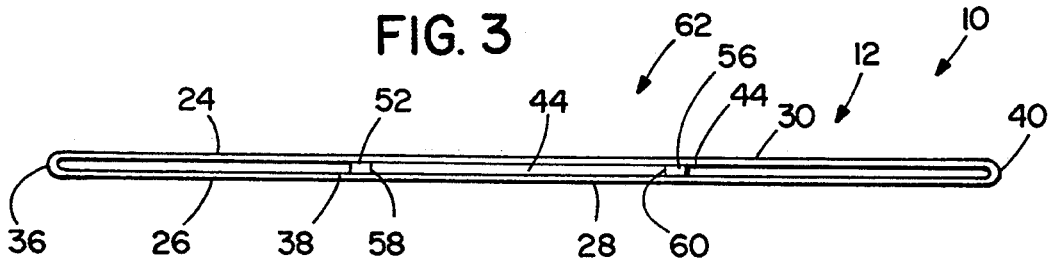
FIG. 3 is a side view of the support structure of FIG. 1 in a folded flat configuration, suitable for storage.

With reference to FIGS. 1, 2, and 3, there is shown a first embodiment of a support structure 10 of the present invention for supporting items such as pots of flowers, bottles and bags in an upright position.

The support structure 10 comprises a peripheral side wall structure 12. The top edge 14 of the peripheral side wall structure 12 defines an open top 16 and the bottom edge 18 of the peripheral side wall structure 12 defines an open bottom 20. The peripheral side wall structure 12 is constructed of a single sheet of material. The material can be, for example, a corrugated paperboard commonly referred to as cardboard or a corrugated plastic. In the event the material of the side wall structure 12 is corrugated material, it is advantageous in some respects that the corrugations 22 are vertically oriented as illustrated in FIG. 1 so that the container 10 has column strength and also so that the side walls can bulge or bow outwardly about the longitudinal axis of the corrugations to accommodate large pots of flowers, numerous bottles or overly-filled bags and the like. In the unfolded or in-use configuration (see FIGS. 1 and 2), the peripheral side wall structure 12 is generally rectangular in perimeter configuration having a first side wall 24, a second side wall 26 generally perpendicular to the first side wall 24, a third side wall 28 opposite and parallel to the first side wall 24, and a fourth side wall 30 opposite and parallel to the second side wall 26. One free end 32 of the single sheet of material is secured to the other free end 34 of the single sheet of material by means of securing means such as, for example, staples, tape or an adhesive. The juncture of the first side wall 24 and second side wall 26 forms a first corner 36, the juncture of the second side wall 26 and third side wall 28 forms a second corner 38, the juncture of the third side wall 28 and fourth side wall 30 form a third corner 40, and the juncture of the fourth side wall 30 and first side wall 24 forms a fourth corner 42. The free ends 32 and 34 of the sheet material are conveniently joined together at a corner of the container 10, for example, the first corner 36. Each of the four corners 36, 38, 40, 42 of the peripheral side wall structure 12 also defines a hinge joint so that the side walls 24, 26, 28, 30 can be folded relative to each other about the four corners of the peripheral wall structure 12. In addition, the container 10 further includes a partition 44 extending, for example, between the first side wall 24 and third side wall 28 and dividing space defined by the peripheral side wall structure 12 into two item-receiving compartments 46 and 48. One end 50 of the partition 44 is folded to form a small first flange 52 and the first flange 52 is disposed in juxtaposition to the interior surface of the first side wall 24. The opposite end 54 of the partition 44 is folded in the opposite direction to the folded direction of the first flange 52 to form a small second flange 56, and the second flange 56 is disposed in juxtaposition to the interior surface of the third side wall 28. The first flange 52 can be secured to the interior surface of the third side wall 28 by means of, for example, staples, tape, or an adhesive. The fold line 58 of the first flange 52 and the fold line 60 of the second flange 56 also define hinge joints about which the partition 44 can fold relative to the first side wall 24 and third side wall 28.

FIGS. 1 and 2 illustrate the support structure 10 in the in-use unfolded configuration for receiving items such as pots of flowers, bottles, bags and the like in the item-receiving compartments 46 and 48. In the in-use configuration, the first side wall 24, second side wall 26, third side wall 28 and fourth side wall 30 are unfolded about the hinge joints at the four corners 36, 38, 40, 42 of the peripheral side wall structure 12 and the partition 44 is unfolded about the hinged joints at the fold line 58 of the first flange 52 and the fold line 60 of the second flange 56 to form a generally rectangular configuration with the partition 44 dividing the interior thereof into the two item-receiving compartments 46, 48.

With reference once again to FIGS. 1 and 2, the side walls 24, 26, 28, 30 can be formed with vertical fold lines 31 which provide for joint lines about which the side walls can bulge or bow outwardly to accommodate large flower pots, large bottles, bulging bags and the like. This feature is particularly advantageous wherein the corrugations are horizontally disposed.

FIG. 3 illustrates the support structure 10 in the storable folded configuration. In the storable configuration, the first side wall 24, second side wall 26, third side wall 28 and fourth side wall 30 are folded about the hinge joints at the four corners 36, 38, 40, 42 of the peripheral side wall structure 12 and the partition 44 is folded relative to the first side wall 24 and third side wall 28 about the hinge joints at the fold lines 58, 60, respectively, so that the first side wall 24 and fourth side wall 30 are generally coplanar, so that the second side wall 26 and third side wall 28 are generally coplanar, and the partition 44 is disposed between and flat against the coplanar first and third side walls and the coplanar second and fourth side walls. In the folded storable configuration, the folded container 10 forms a thin stack 62 which requires a minimum space for storage.

With reference to FIGS. 4, 5, 6, 7, and 8, there is shown a second embodiment of a support structure 110 of the present invention for supporting items such as flower pots, bottles, bags, and the like in an upright position.

The support structure 110 comprises a first peripheral side wall structure 112A and a second peripheral wall structure 112B. The top edge 114A of the first peripheral side wall structure 112A defines an open top 116A and the bottom edge 118A of the first peripheral side wall structure 112A defines an open bottom 120A. Likewise, the top edge 114B of the second peripheral side wall structure 112B defines an open top 116B and the bottom edge 118B of the second peripheral side wall structure 112B defines an open bottom 120B. The first peripheral side wall structure 112A and second peripheral side wall structure 112B are formed of a single continuous sheet of material folded to define the two peripheral side wall structures 112A and 112B. The material can be, for example, a corrugated paperboard commonly referred to as cardboard or a corrugated plastic. In the event the material of the side wall structures 112A, 112B is corrugated material, it is advantageous that the corrugations are vertically oriented. In the unfolded or in-use configuration (see FIGS. 4, 5, 6, and 7), the first peripheral side wall structures 112A and 112B are each generally rectangular in peripheral configuration. The first peripheral side wall structure 112A has a first side wall 124A, a second side wall 126A generally perpendicular to the first side wall 124A, a third side wall 128A opposite and parallel to the first side wall 124A, and a fourth side wall 130A opposite and parallel to the second side wall 126A which side walls cooperate to define a first item-receiving compartment 146. The second peripheral side wall structure 112B has a first side wall 124B, a second side wall 126B generally perpendicular to the first side wall 124B, a third side wall 128B opposite and parallel to the first side wall 124B, and a fourth side wall 130B opposite and parallel to the second side wall 126B, which side walls cooperate to define a second item-receiving compartment 148. Particularly if the side walls are fabricated of a corrugated material with horizontal corrugations, the side walls can be formed with vertical fold lines 129 which provide for joint lines about which the side walls can bulge or bow outwardly to accommodate large pots of flowers, large bottles, overly-filled bags, and the like. The first side wall 124A of the first peripheral side wall structure 112A and the first side wall 124B of the second peripheral side wall structure 112B are formed of a continuous sheet of material and constitutes a unitary structure. One free end 132 of the single sheet of material constitutes the end edge of the fourth side wall 130A of the first peripheral side wall structure 112A and the other free end 134 of the single sheet of material constitutes the end edge of the fourth side wall 130B of the second peripheral side wall structure 112B. The end edge 132 of the fourth side wall 130A is secured to the interior surface of the continuous side wall 124 proximate the mid-point thereof, and the end edge 134 of the fourth side wall 130B is also secured to the interior surface of the continuous side wall 124 proximate the midpoint thereof in juxtaposition to the end edge 132. Toward this objection, the end 132 of the fourth side wall 130A is folded to form a small first flange 133, and the first flange 133 is disposed in juxtaposition to the interior surface of the first side wall 124A, and the end 134 of the fourth side wall 130B is folded to form a small second flange 135, and the second flange 135 is disposed in juxtaposition to the interior surface of the first side wall 124B. The first flange 133 can be secured to the interior surface of the first side wall 124A and the second flange 135 can be secured to the interior surface of the first side wall 124B by means of, for example, staples, tape or an adhesive. The fold line 137 of the first flange 133 and the fold line 139 of the second flange 135 define hinge joints. With regard to the first peripheral side wall structure 112A, the juncture of the first side wall 124A and the second side wall 126A forms a first corner 136A, the juncture of the second side wall 126A and the third side wall 128A forms a second corner 138A, the juncture of the third side wall 128A and fourth side wall 130A form a third corner 140A, and the juncture of the end edge 132 of the fourth side wall 130A and first side wall 124A forms a fourth corner 142A. Similarly, with regard to the second peripheral side wall structure 112B, the juncture of the first side wall 124B and second side wall 126B forms a first corner 136B, the juncture of the second side wall 128B and third side wall 128B forms a second corner 138B, the juncture of the third side wall 128B and fourth side wall 130B forms a third corner 140B, and the juncture of the end edge 134 of the fourth side wall 130B and first side wall 124B forms a fourth corner 142B. Each of the four corners 136A, 138A, 140A and 142A of the first peripheral side wall structure 112A defines a hinge joint so that the side walls 124A, 126A, 128A, 130A can be folded relative to each other bout the four corners. Each of the four corners 136B, 138B, 140B and 142B of the second peripheral side wall structure 112B defines a hinge joint so that the side walls 124B, 126B, 128B, 130B can be folded relative to each other about the four corners. In addition, the continuous side wall 124, which comprises the first side walls 124A and 124B, is formed with a fold line 143 at its mid-point which divides the continuous side wall 124 into the first side wall 124A and second side wall 124B so that the first side wall 124A and second side wall 124B can be folded about the fold line 143 relative to each other.

Figure 4:
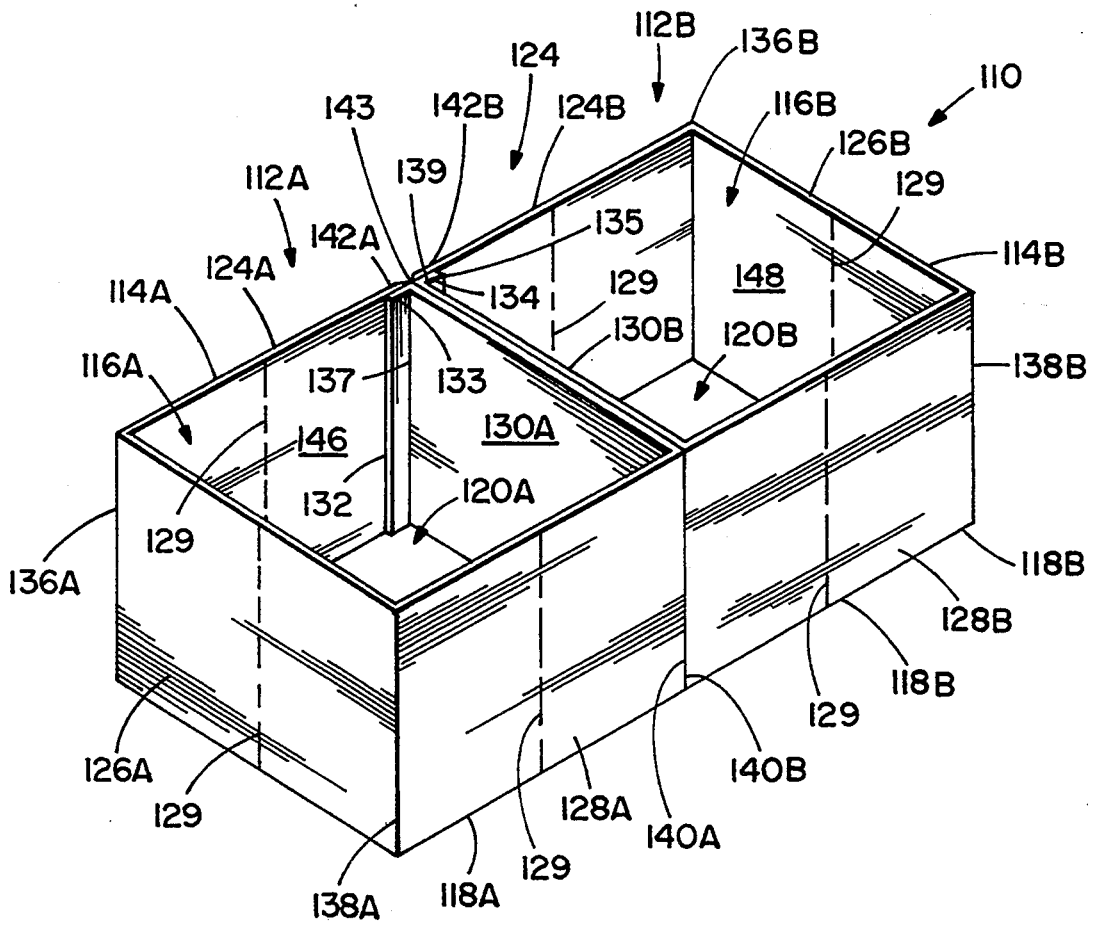
FIG. 4 is a perspective view of another embodiment of a support structure of the present invention, in an unfolded in-use configuration.
Figure 5:
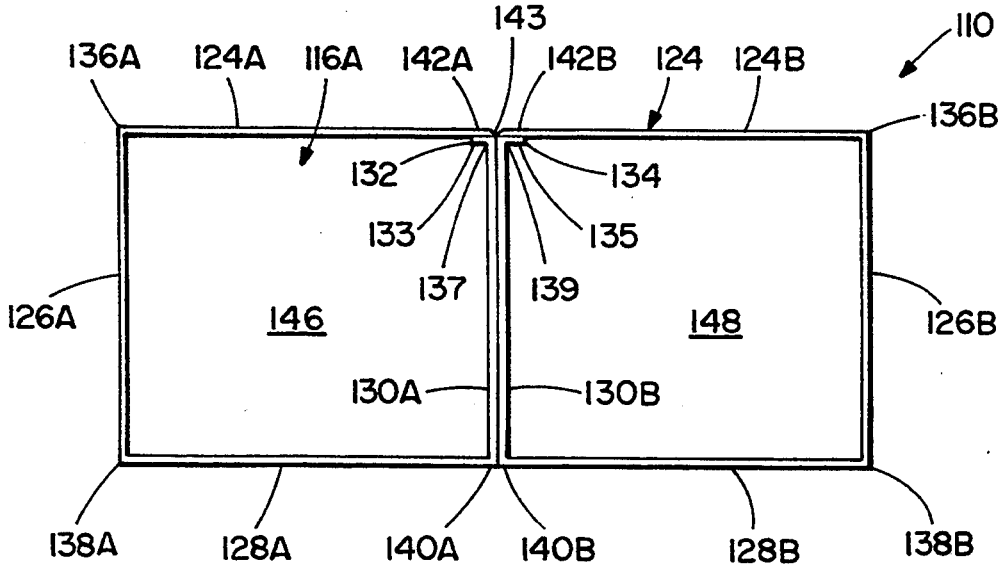
FIG. 5 is a top view of the support structure of FIG. 4 in one arrangement of components.
Figure 6:
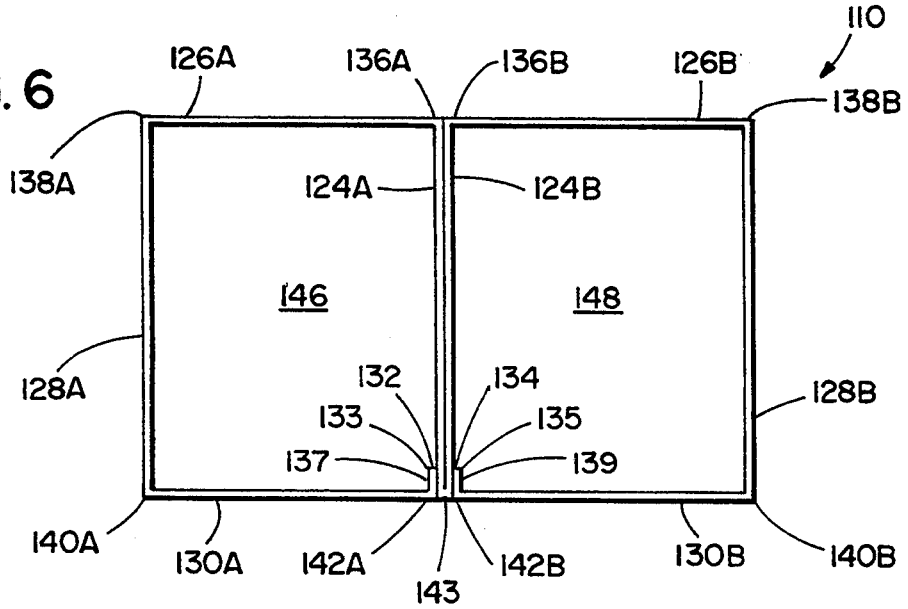
FIG. 6 is a top view of the support structure of FIG. 4 in another arrangement of components.
Figure 7:
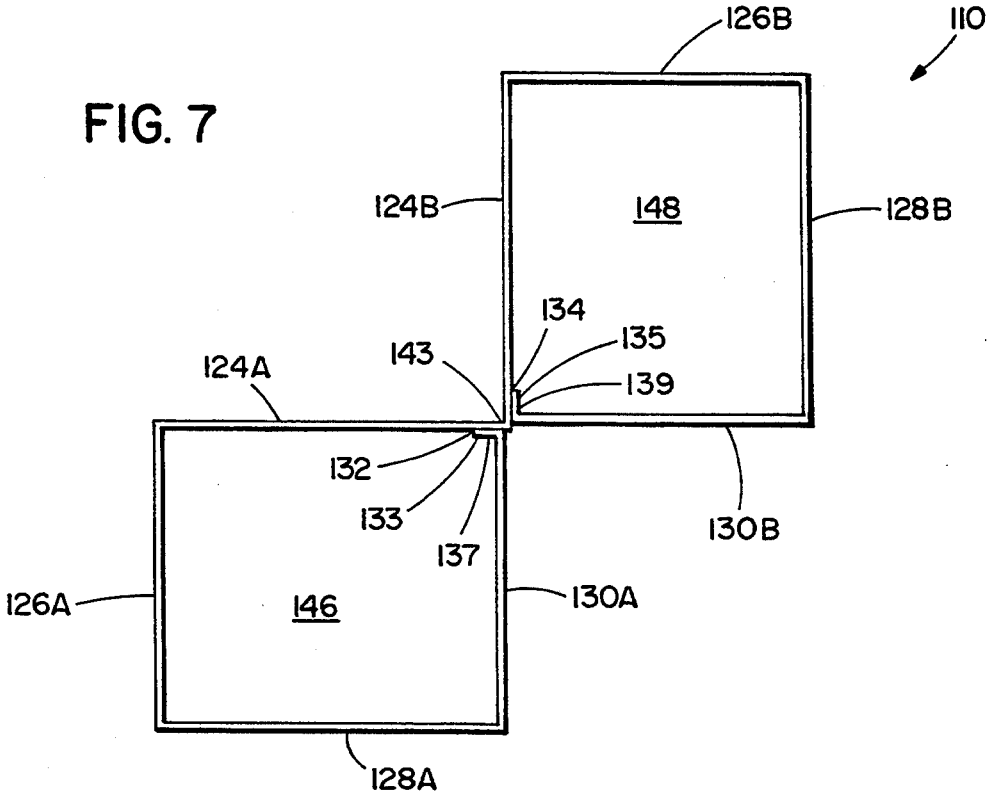
FIG. 7 is a top view of the support structure of FIG. 4 in yet another arrangement of components.

FIGS. 5, 6, and 7 illustrate the support structure 110 in the in-use unfolded configuration for receiving items in the item-receiving compartments 146, 148. The first peripheral side wall structure 112A forming the first bag-receiving compartment 146 is formed by unfolding the first side wall 124A, second side wall 126A, third side wall 128A and fourth side wall 130A about the hinge joints at the three corners 136A, 138A, 140A, and about the hinge joint at the fourth corner 142A defined at the fold line 137 at the first flange 133 of the fourth side wall 130A and fold line 143 in the side wall 124 to form the generally rectangular configured first peripheral side wall structure 112A. Likewise, the second peripheral side wall structure 112B forming the second bag-receiving compartment 148 is formed by unfolding the first side wall 124B, second side wall 126B, third side wall 128B and fourth side wall 130B about the hinge joints at the three corners 136B, 138B, 140B and about the hinge joint at the fourth corner 142B defined at the fold line 139 at the second flange 136 of the fourth side wall 130B and fold line 143 in the wall 124 to form the generally rectangular configurated second peripheral side wall structure 112B. In FIGS. 4 and 5, the first peripheral side wall structure 112A and second peripheral side wall structure 112B are oriented about the common fold line 143 in the continuous side wall 124 such that the fourth side wall 130A of the first peripheral side wall structure 112A and fourth side wall 130B of the second peripheral side wall structure 112B are in side-by-side mutually-overlaying relationship. In FIG. 6, the first peripheral side wall structure 112A and second peripheral side wall structure 112B are oriented about the common fold line 143 in the continuous side wall 124 such that the first side wall 124A of the first peripheral side wall structure 112A and the first side wall 124B of the second peripheral side wall structure 112B are in side-by-side mutually-overlaying relationship. In FIG. 7, the first peripheral side wall structure 112A and second peripheral side wall structure 112B are oriented about the common fold line 143 in the continuous side wall 124 such that the first side wall 124A of the first side wall structure 112A and the first side wall 124B of the second peripheral side wall structure 112B are at an included angle to each other of less than 180 Degrees, for example, 90 Degrees. FIGS. 5, 6, and 7 illustrate the versatility of the support structure 112 showing three configurations of a plurality of different configurations which can be formed providing for the fitting of the support structure 110 into spaces of different sizes and configurations, such as automobile trunks of different sizes and configurations. For purposes of the present example, the eight sidewalls or panels of the unitary sheet which form the compartments 146 and 148 can also be counted successively from one to eight beginning with the end panel 130A on one end of the sheet and ending with end panel 130B on an opposite end of the sheet or vice versa. The panels can be identified and referred to accordingly. Thus, foldable corner 143, which comprises a single axis about which the compartments 146 and 148 can be rotationally displaced relative to one another, lies between a fourth and a fifth one of said panels, namely, panels 124A and 124B, respectivley, or vice versa, depending on whether the panel count begins with end panel 130A or with end panel 130B.

Figure 8:
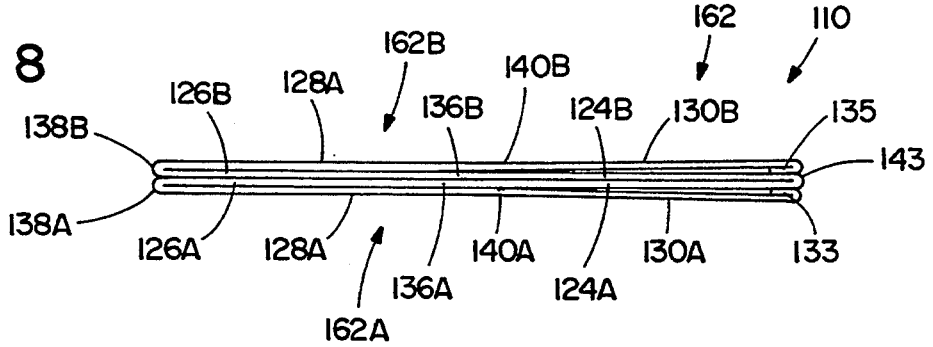
FIG. 8 is a side view of the support structure of FIG. 1 in a folded flat configuration suitable for storage.

FIG. 8 illustrates the support structure 110 in the storable folded configuration. In the storable configuration of the first peripheral side wall structure 112A, the first side wall 124A, second side wall 126A, third side wall 128A and fourth side wall 130A are folded about the hinge joints at the three corners 136A, 138A, 140A and about the hinge joint at the fourth corner 142A defined at the fold line 137 and fold line 143 so that the first side wall 124A and second side wall 126A are generally coplanar, so the third side wall 128A and fourths side wall 130A are generally coplanar, and the coplanar first and second side walls are in overlaying side-by-side juxtaposition to the coplanar third and fourth side walls to form a thin first stack 162A. The storable configuration of the second peripheral side wall structure 112B, the first side wall 124B, second side wall 126B, third side wall 128B and fourth side wall 130B are folded about the hinge joints at the three corners 136B, 138B, 140B and about the hinge joint at the fourth corner 142B defined at the fold line 139 and fold line 143 so that the first side wall 124B and second side wall 126B are generally coplanar, so the third side wall 128B and fourth side wall 130B are generally coplanar, and the coplanar first and second side walls are in overlaying side-by-side juxtaposition to the coplanar third and fourth side walls to form a thin second stack 162B. Also, the folded flat first stack 162A and folded flat second stack 162B are folded about the fold line 143 of the first continuous side wall 124 so that the coplanar first and second side walls 124A and 126A of the first stack 162A are in overlay juxtaposition with the coplanar first and second side walls 124B and 126B of the second stack 162A to form a thin final stack 162.

Figure 9:
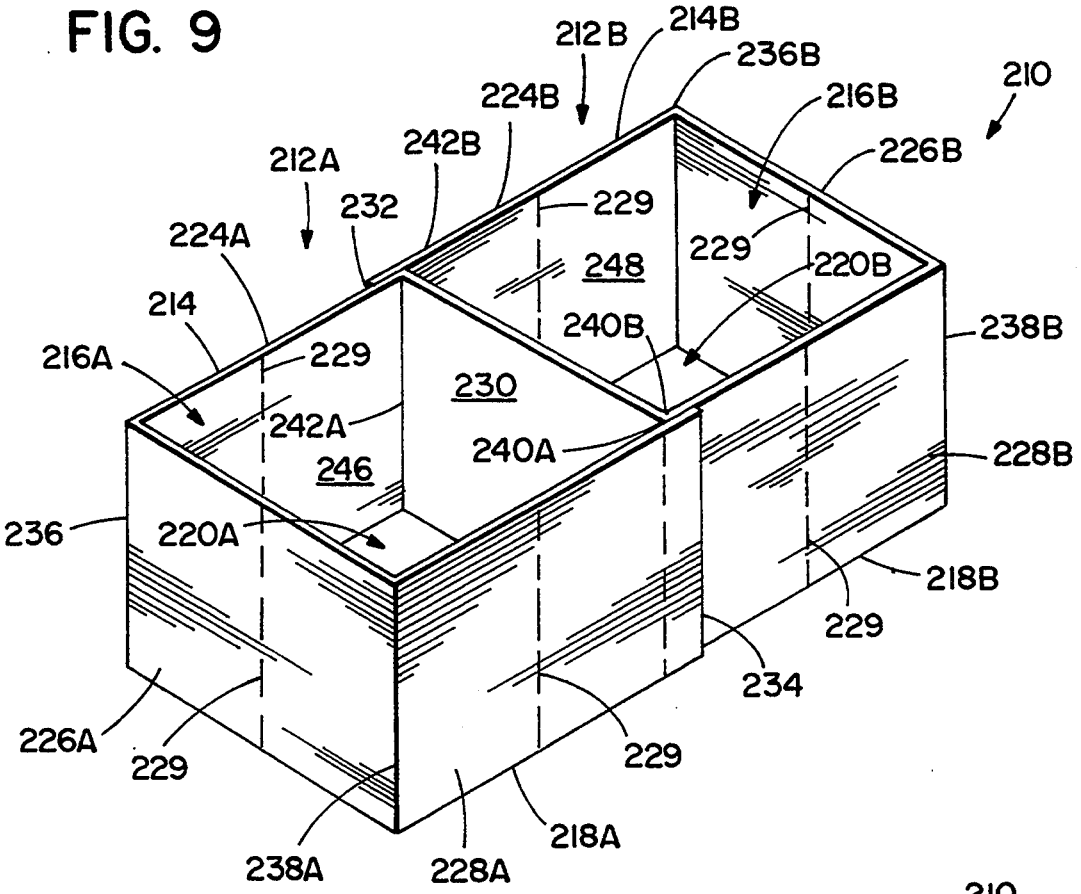
FIG. 9 is a perspective view of yet another embodiment of a support structure of the present invention in an unfolded in-use configuration.
Figure 10:
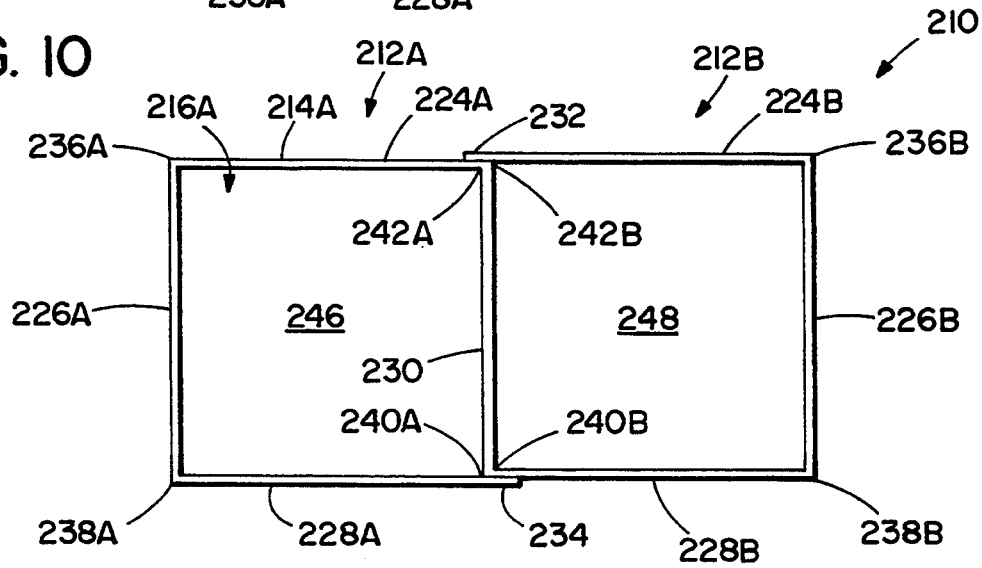
FIG. 10 is a top view of the support structure of FIG. 9.
Figure 11:
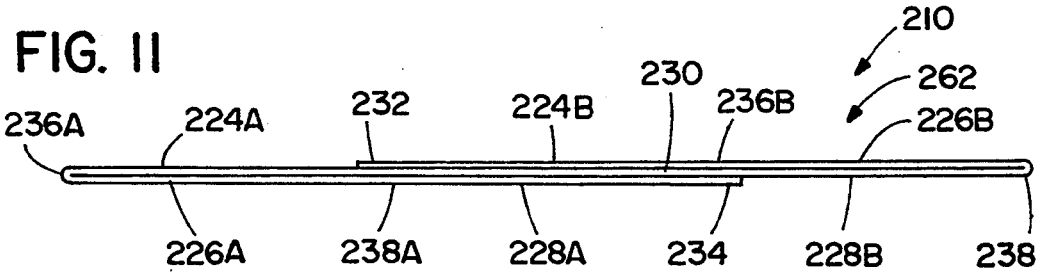
FIG. 11 is a side view of the support structure of FIG. 9 in a folded flat configuration suitable for storage.

With reference to FIGS. 9, 10, 11, there is shown a third embodiment of a support structure 210 of the present invention for supporting items such as flower pots, bottles, bags, and the like an upright position.

The support structure 210 comprises a first peripheral side wall structure 212A and a second peripheral wall structure 212B. The top edge 214A of the first peripheral side wall structure 212A defines an open top 216A and the bottom edge 218A of the first peripheral side wall structure 212A defines an open bottom 220A. Likewise, the top edge 214B of the second peripheral side wall structure 212B defines an open top 216B and the bottom edge 218B of the second peripheral side wall structure 212B defines an open bottom 220B. The first peripheral side wall structure 212A and second peripheral side wall structure 212B are formed of a single sheet of material folded to define the two peripheral side wall structures 212A and 212B. The material can be, for example, a corrugated paperboard commonly referred to as cardboard or a corrugated plastic. In the event the material of the side wall structures 212A, 212B is corrugated material, it is advantageous that the corrugations are vertically oriented. In the unfolded or in-use configuration (see FIGS. 9 and 10), the first peripheral side wall structures 212A and 212B are each generally rectangular in peripheral configuration. The first peripheral side wall structure 212A has a first side wall 224A, a second side wall 226A generally perpendicular to the first side wall 224A, a third side wall 228A opposite and parallel to the first side wall 224A, and a fourth side wall 230 opposite and parallel to the second side wall 226A which side walls cooperate to define a first item-receiving compartment 246. The second peripheral side wall structure 212B has a first side wall 224B, a second side wall 226B generally perpendicular to the first side wall 224B, a third side wall 228B opposite and parallel to the first side wall 224B and the fourth side wall 230 opposite and parallel to the second side wall 226B which side walls cooperate to define a second item-receiving compartment 248. The fourth side wall of the first peripheral wall structure 212A and the fourth side wall of the second peripheral wall structure 212B is a common wall, and is, therefore, denoted as the identical numeral 230. The first side wall 224A of the first peripheral side wall structure 212A and the first side wall 224B of the second peripheral side wall structure 212B are formed of a single continuous sheet of material folded to define the two peripheral side wall structures 212A and 212B, and constitutes a unitary structure. One free end 232 of the single sheet of material constitutes the end edge of the first side wall 224B of the second peripheral side wall structure 212B and the other free end 234 of the single sheet of material constitutes the end edge of the third side wall 228A of the first peripheral side wall structure 212A. The end edge 232 of the first side wall 224B overlaps the exterior surface of the first side wall 224A and is attached thereto by attachment means such as staples, tape, or an adhesive. The end edge 234 of the third side wall 228A overlaps the exterior surface of the third side walls 228B and is attached thereto by attachment means such as staples, tape or an adhesive. With regard to the first peripheral side wall structure 212A, the juncture of the first side wall 224A and second side wall 226A forms a first corner 236A, the juncture of the second side wall 226A and third side wall 228A forms a second corner 238A, the juncture of the third side wall 228A and common fourth side wall 230 forms a third corner 240A, and the juncture of the common fourth side wall 230 with the first side wall 226A forms a fourth corner 242A. Similarly, with regard to the second peripheral side wall structure 212B, the juncture of the first side wall 224B and second side wall 226B forms a first corner 236B, the juncture of the second side wall 226B and third side wall 228B forms a second corner 238B, the juncture of the third side wall 228B and common fourth side wall 230B forms a third corner 240B, and the juncture of the common fourth wall side wall 230 and first side wall 224B forms a fourth corner 242B. Each of the four corners 236A, 238A, 240A and 242A of the first peripheral side wall structure 212A defines a hinge joint so that the side walls 224A, 226A, 228A, 230 can be folded relative to each other. Each of the four corners 236B, 238B, 240B and 242B of the second peripheral side wall structure 212B defines a hinge joint so that the side walls 224B, 226B, 228B, 230 can be folded relative to each other.

Particularly, if the side walls of the container 210 are fabricated of a corrugated material with horizontal corrugations, the side walls can be formed with vertical fold lines 229 which provide for joint lines about which the side walls can bulge or bow outwardly to accommodate overly-filled bags.

FIGS. 9 and 10 illustrate the support structure 210 in the in-use unfolded configuration for receiving items in the item-receiving compartments 246, 248. The first peripheral side wall structure 212A forming the first bag-receiving compartment 246 is formed by unfolding the first side wall 224A, second side wall 226A, third side wall 228A and common fourth wall 230 about the corner hinge joints to form the generally rectangular configured first peripheral side wall structure 212A. Likewise and concurrently in time, the second peripheral side wall structure 212B forming the second bag-receiving compartment 248 is formed by unfolding the first side wall 224B, second side wall 226B, third side wall 228B and common fourth wall 230 about the corner hinge joints to form the generally rectangular configured second peripheral side wall structure 212B.

FIG. 11 illustrates the support structure 210 in the storable folded configuration. In the storable configuration, the first side wall 224A, first side wall 224B, and second side wall 228B are coplanar, the second side wall 226A, third side wall 228A and third side wall 228B are coplanar and in side-by-side juxtaposition with the coplanar side walls 224A, 224B, 228B and the fourth side wall 230 disposed therebetween to form a thin stack 262.

Figure 12:
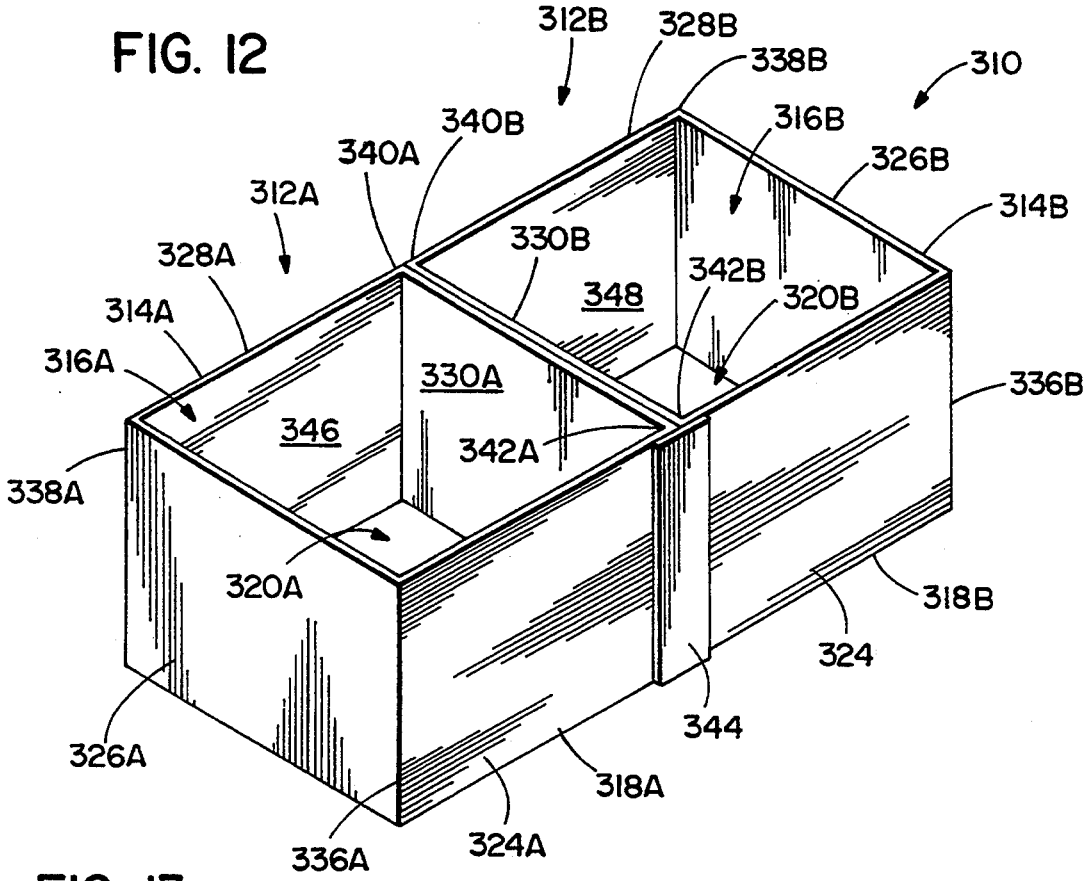
FIG. 12 is a perspective view of still another embodiment of a support structure of the present invention in an unfolded in-use configuration.
Figure 13:
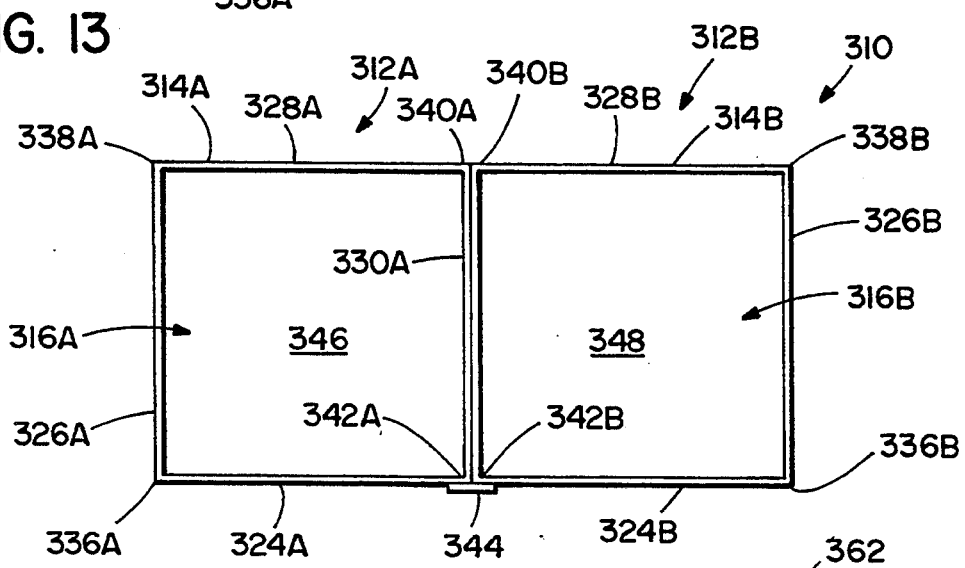
FIG. 13 is a top view of the support structure of FIG. 12.
Figure 14:
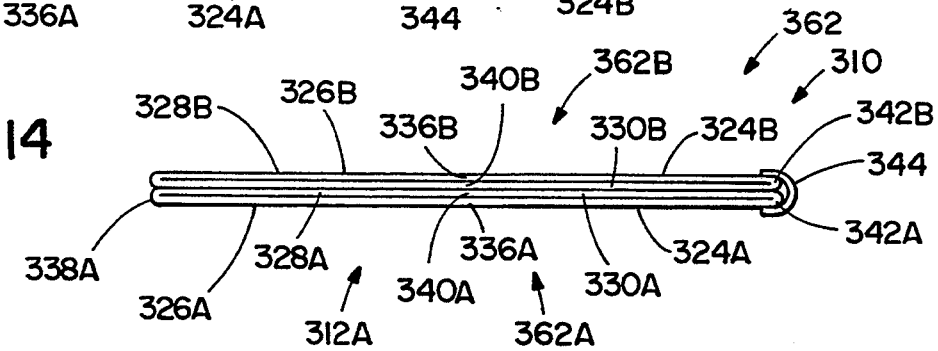
FIG. 14 is a side view of the support structure of FIG. 12 in a folded flat configuration suitable for storage.

With reference to FIGS. 12, 13 and 14, there is shown another or fourth embodiment of a support structure 310 for holding items such as pots of flowers, bottles, bags, and the like upright.

The support structure 310 comprises a first peripheral side wall structure 312A and a second peripheral wall structure 312B. The top edge 314A of the first peripheral side wall structure 312A defines an open top 316A and the bottom edge 318A of the first peripheral side wall structure 312A defines an open bottom 320A. Likewise, the top edge 314B of the second peripheral side wall structure 312B defines an open top 316B and the bottom edge 318B of the second peripheral side wall structure 312B defines an open bottom 320B. The first peripheral side wall structure 312A and second peripheral side wall structure 312B are separate elements of the container 310 and are secured together as will be hereinafter discussed. In the unfolded or in-use configuration (see FIGS. 12 and 13), the first peripheral side wall structures 312A and 312B are each generally rectangular in peripheral configuration. The first peripheral side wall structure 312A has a first side wall 324A, a second side wall 326A generally perpendicular to the first side wall 324A, a third side wall 328A opposite and parallel to the first side wall 324A, and a fourth side wall 330A opposite and parallel to the second side wall 326A which side walls cooperate to define a first item-receiving compartment 346. The second peripheral side wall structure 312B has a first side wall 324B, a second side wall 326B generally perpendicular to the first side wall 324B, a third side wall 328B opposite and parallel to the first side wall 324B, and a fourth side wall 330B opposite and parallel to the second side wall 326B which side walls cooperate to define a second item-receiving compartment 348. With regard to the first peripheral side wall structure 312A, the juncture of the first side wall 324A and second side wall 326A forms a first corner 336A, the juncture of the second side wall 326A and third side wall 328A forms a second corner 338A, the juncture of the third side wall 328A and fourth side wall 330A form a third corner 340A and the juncture of the fourth side wall 330A and first side wall 324A forms a fourth corner 342A. Similarly, with regard to the second peripheral side wall structure 312B, the juncture of the first side wall 324B and second side wall 326B forms a first corner 336B, the juncture of the second side wall 326B and third side wall 328B forms a second corner 338B, the juncture of the third side wall 328B and fourth side wall 330B forms a third corner 340B, and the juncture of the fourth side wall 330B and first side wall 324B forms a fourth corner 342B. Each of the four corners 336A, 338A, 340A and 342A of the first peripheral side wall structure 312A defines a hinge joint so that the side walls 324A, 326A, 328A, 330A can be folded relative to each other about the four corners. Each of the four corners 336B, 338B, 340B and 342B of the second peripheral side wall structure 312B defines a hinge joint so that the side walls 324B, 326B, 328B, 330B can be folded relative to each other about the four corners. The first peripheral side wall structure 312A and second peripheral side structure 312B are disposed in side-by-side juxtaposition with the first side wall 324A of the first peripheral side wall structure attached to the first side wall 324B of the second peripheral side wall structure 312B. The means for attaching the first peripheral side wall structure 312A to the second peripheral side wall structure 312B can be staples, an adhesive, or as shown, a strip of tape 344 extending along the length of the interface of the fourth corner 342A of the first peripheral side wall structure 312A and fourth corner 342B of the second peripheral side wall structure 312B and overlapping the adjacent portions of the first side wall 324A and second side wall 324B.

FIGS. 12 and 13 illustrate the support structure 310 in the in-use unfolded configuration for receiving items in the item-receiving compartments 346, 348. The peripheral side wall structure 310 defining the first item compartment 346 is formed by unfolding the first side wall 324A, second side wall 326A, third side wall 328A and fourth side wall 330A are unfolded about the hinge joints at the four corners 336A, 338A, 340A and 342A to form the generally rectangular configured first peripheral side wall structure 312A. Likewise, the second peripheral side wall structure 312B defining the second item-receiving compartment 348 is formed by unfolding the first side wall 324B, second side wall 326B, third side wall 328B and fourth side wall 330B about the hinge joints at the four corners 336B, 338B, 340B, 342B form the generally rectangular configurated second peripheral side wall structure 312B. In FIGS. 12 and 13, the first peripheral side wall structure 312A and second peripehral side wall structure 312B are oriented about the hinge joint formed by the tape strip of tape 344 at the interface of the fourth corner 342A of the first peripheral side wall structure 312A and fourth corner 312B of the second peripheral side wall structure 312B such that the fourth side wall 330A of the first peripheral side wall structure 312A and the fourth side wall 330B of the second peripheral side wall structure 312B are in side-by-side, mutually-overlaying relationship. However, the first peripheral side wall structure 312A and second peripheral side wall structure 312B can be oriented such that the first side wall 324A of the first peripheral side wall structure 312A and the first side wall 324B of the second peripheral side structure 312B are in side-by-side, mutually-overlaying relationship. Also, the first peripheral side wall structure 312A and second peripheral side wall structure 312B can be oriented such that the first side wall 324A of the first peripheral side wall structure 312A and the first side wall 324B of the second peripheral side wall structure 312B are at an included angle to each other of less than 180 Degrees, for example, 90 Degrees.

FIG. 14 illustrates the support structure 310 in the storable folded configuration. In the storable configuration of the first peripheral side wall structure 312A, the first side wall 324A, second side wall 326A, third side wall 328A and fourth side wall 330A are folded about the hinge joints at the fourth corners 336A, 338A, 340A, 342A so that the first side wall 324A and second side wall 326A are generally coplanar, so the third side wall 328A and fourth side wall 330A are generally coplanar, and the coplanar first and second side walls are in overlaying side-by-side juxtaposition to the coplanar third and fourth side walls to form a thin first stack 362A. In the storable configuration, the second peripheral side wall structure 312B, the first side wall 324B, second side wall 326B, third side wall 328B and fourth side wall 330B are folded about the hinge joints at the four corners 336B, 338B, 340B, 342B so that the first side wall 324B and second side wall 326B are generally coplanar, so the third side wall 328B and fourth side wall 330B are generally coplanar, and the coplanar first and second side walls are in overlaying side-by-side juxtaposition to the coplanar third and fourth side walls to form a thin second stack 362B. Also, the folded flat first stack 362A and folded flat second stack 362B are folded about the strip of tape 344 at the interface of the fourth corner 342A of the first peripheral side wall 312A and fourth corner 342B of the second peripheral wall structure 312B so that the coplanar third and fourth side walls 328A and 330A of the first stack 362A are in overlaying juxtaposition with the coplanar third and fourth side walls 328B and 330B of the second stack 362B to form a thin final stack 362.

Figure 15:
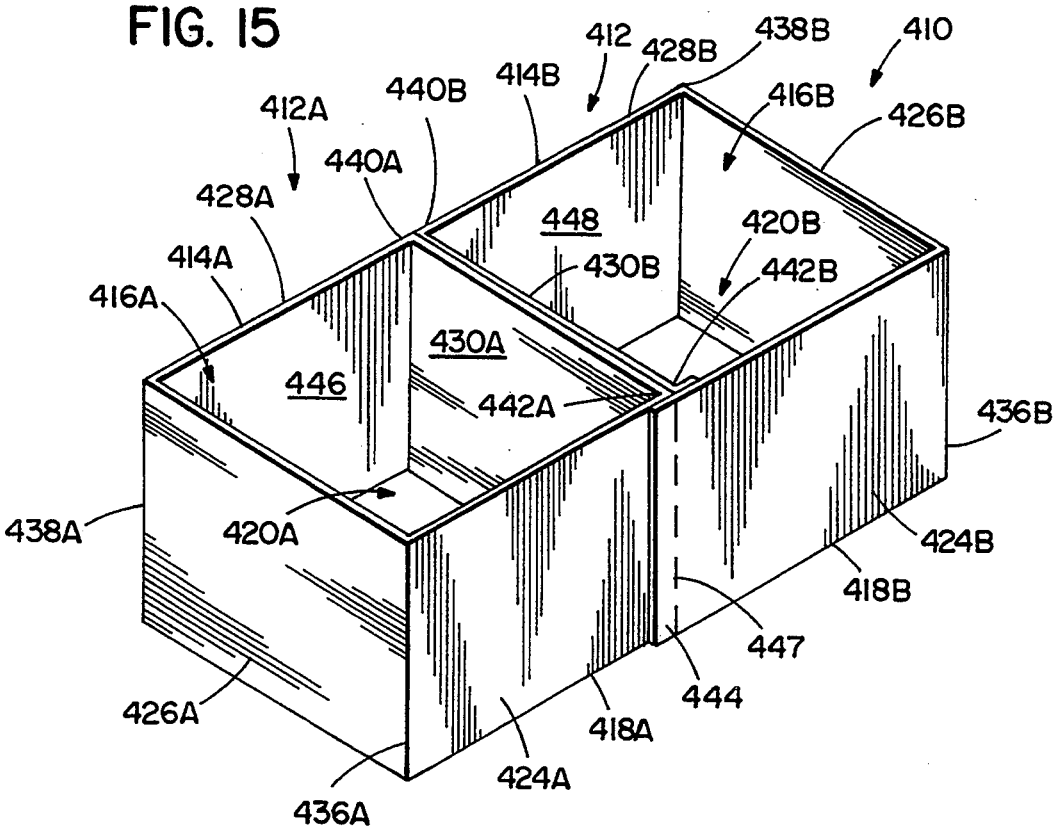
FIG. 15 is a perspective view of yet another embodiment of a support structure of the present invention in an unfolded in-use configuration.
Figure 16:
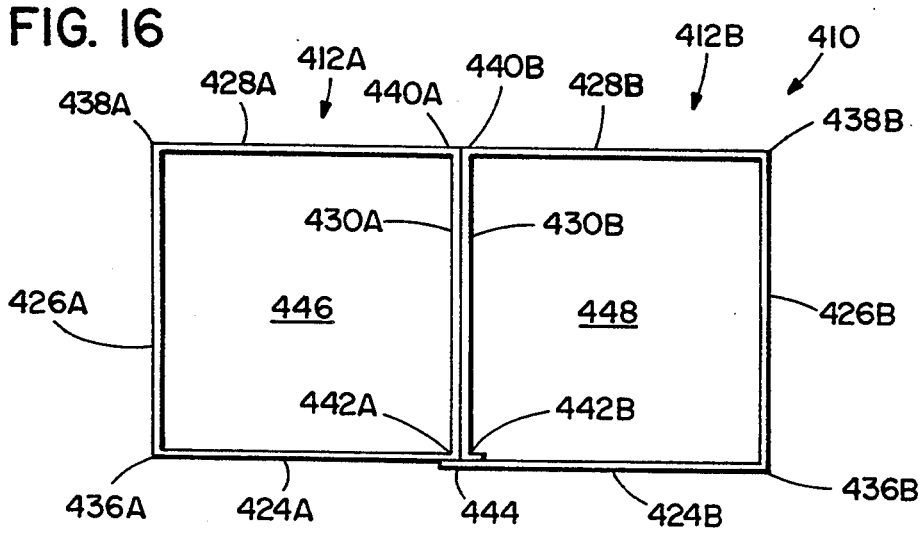
FIG. 16 is a top view of the support structure of FIG. 15.
Figure 17:
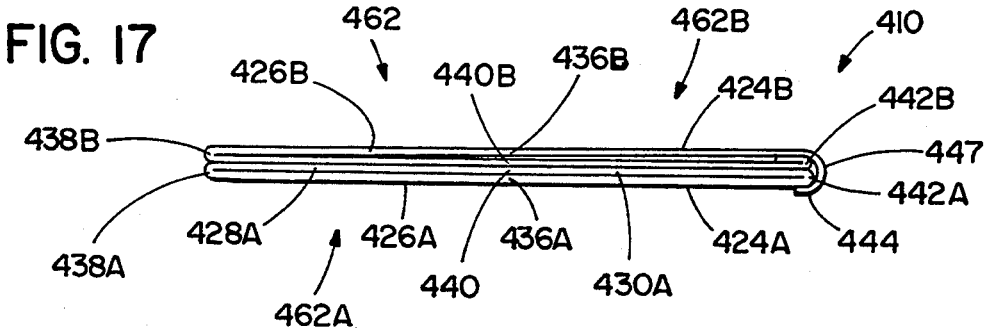
FIG. 17 is a side view of the support structure of FIG. 15 in a folded flat configuration suitable for storage.

With reference to FIGS. 15, 16, and 17, there is shown a further or fifth embodiment of a container 410 for holding items such as pots of flowers, bottles, bags, and the like upright.

The support structure 410 comprises a first peripheral side wall structure 412A and a second peripheral wall structure 412B. The top edge 414A of the first peripheral side wall structure 412A defines an open top 416A and the bottom edge 418A of the first peripheral side wall structure 412A defines an open bottom 420A. Likewise, the top edge 414B of the second peripheral side wall structure 412B defies an open top 416B and the bottom edge 418B of the second peripheral side wall structure 412B defines an open bottom 420B. The first peripheral side wall structure 412A and second peripheral side wall structure 412B are separate elements of the support structure 410 and are secured together as will be hereinafter discussed. In the unfolded or in-use configuration (see FIGS. 15 and 16), the first peripheral side wall structures 412A and 412B are each generally rectangular in peripheral configuration. The first peripheral side wall structure 412A has a first side wall 424A, a second side wall 426A generally perpendicular to the first side wall 424A, a third side wall 428A opposite and parallel to the first side wall 424A, and a fourth side wall 430A opposite and parallel to the second side wall 426A which side walls cooperate to define a first item-receiving compartment 446. The second peripheral side wall structure 412B has a first side wall 424B, a second side wall 426B generally perpendicular to the first side wall 424B, a third side wall 428B opposite and parallel to the first side wall 424B, and a fourth side wall 430B opposite and parallel to the second side wall 426B which side walls cooperate to define a second item-receiving compartment 448. With regard to the first peripheral side wall structure 412A, the juncture of the first side wall 424A and second side wall 426A forms a first corner 436A, the juncture of the second side wall 426A and third side wall 428A forms a second corner 438A, the juncture of the third side wall 428A and fourth side wall 430A form a third corner 440A and the juncture of the fourth side wall 430A and first side wall 424A forms a fourth corner 442A. Similarly, with regard to the second peripheral side wall structure 412B, the juncture of the first side wall 424B and second side wall 426B forms a first corner 436B, the juncture of the second side wall 426B and third side wall 428B forms a second corner 438B, the juncture of the third side wall 428B and fourth side wall 430B forms a third corner 440B, and the juncture of the fourth side wall 430B and first side wall 424B forms a fourth corner 442B. Each of the four corners 436A, 438A, 440A and 442A of the first peripheral side wall structure 412A defines a hinge joint so that the side walls 424A, 426A, 428A, 430A can be folded relative to each other about the four corners. Each of the four corners 436B, 438B, 440B and 442B of the second peripheral side wall structure 412B defines a hinge joint so that the side walls 424B, 426B, 428B, 430B can be folded relative to each other about the four corners. The first peripheral side wall structure 412A and second peripheral side structure 412B are disposed in side-by-side juxtaposition with the first side wall 424A of the first peripheral side wall structure attached to the first side wall 424B of the second peripheral side wall structure 412B. Toward this objection, the first side wall 424B of the second peripheral side wall structure 412B extends past the juncture of the fourth side wall 430B and first side wall 424B to form an attachment flap 444, and the attachment flap 444 of the first side wall 424B of the second peripheral side wall 424B is disposed in overlapping relationship with the exterior surface of the first side wall 424A of the first peripheral side wall 412A. The attachment flap 444 of the first side wall 424B is secured to the overlapped position of the first side wall 424B by means of, for example, stapes or an adhesive. In addition, the first side wall 424B is formed with a fold line 447 in alignment with the fourth corner 442A of the first peripheral side wall structure 412A formed by the intersection of the first side wall 424A and fourth side wall 430A to define a hinge joint.

FIGS. 15 and 16 illustrate the support structure 410 in the in-use unfolded configuration for receiving bags in the bag-receiving compartments 446, 448. The peripheral side wall structure 410 defining the first bag compartment 446 is formed by unfolding the first side wall 424A, second side wall 426A, third side wall 428A and fourth side wall 430A are unfolded about the hinge joints at the four corners 436A, 438A, 440A, and 442A to form the generally rectangular configured first peripheral side wall structure 412A. Likewise, the second peripheral side wall structure 412B defining the second bag-receiving compartment 448 is formed by unfolding the first side wall 424B, second side wall 426B, third side wall 428B and fourth side wall 430B about the hinge joints at the four corners 436B, 438B, 440B, 442B form the generally rectangular configurated second peripheral side wall structure 412B. In FIGS. 15 and 16, the first peripheral side wall structure 412A and second peripheral side wall structure 412B are oriented about the fold line 447 of the attachment flap 444 at the interface of the fourth corner 442A of the first peripheral side wall structure 412A and fourth corner 442B of the second peripheral side wall structure 412B such that the fourth side wall 430A of the first peripheral side wall structure 412A and the fourth side wall 430B of the second peripheral side wall structure 412B are in side-by-side, mutually-overlaying relationship. However, the first peripheral side wall structure 412A and second peripheral side wall structure 412B can be oriented such that the first side wall 424A of the first peripheral side wall structure 412A and the first wall 424B of the second peripheral side structure 412B are in side-by-side, mutually-overlaying relationship. Also, the first peripheral side wall structure 412A and second peripheral side wall structure 412B can be oriented such that the first side wall 424A of the first peripheral side wall structure 412A and the first side wall 424B of the second peripheral side wall structure 412B are at an included angle to each other of less than 180 Degrees for example, 90 Degrees.

FIG. 17 illustrates the support structure 410 in the storable folded configuration. In the storable configuration of the first peripheral side wall structure 412A, the first side wall 424A, second side wall 426A, third side wall 428A and fourth side wall 440A are folded about the hinge joints at the fourth corners 436A, 438A, 440A, 442A so that the first side wall 424A and second side wall 426A are generally coplanar, so the third side wall 428A and fourth side wall 430A are generally coplanar, and the coplanar first and second side walls are in overlaying side-by-side juxtaposition to the coplanar third and fourth side walls to form a thin first stack 462A. In the storable configuration of the second peripheral side wall structure 412B, the first side wall 424B, second side wall 426B, third side wall 428B and fourth side wall 430B are folded about the hinge joints at the four corners 436B, 438B, 440B, 442B so that the first side wall 424B and second side wall 426B are generally coplanar, so the third side wall 428B and fourth side wall 430B are generally coplanar, and the coplanar first and second side walls are in overlaying side-by-side juxtaposition to the coplanar third and fourth side walls to form a thin second stack 462B. Also, the folded flat first stack 462A and folded flat second stack 462B are folded about the fold line 447 of the flap 444 of the first side wall 424A at the fourth corner 442A of the first peripheral side wall 412A so that the coplanar third and fourth side walls 428A and 430A of the first stack 462A are in overlaying juxtaposition with the coplanar third and fourth side walls 428B and 430B of the second stack 462B to form a thin final stack 462.

With reference to FIGS. 18, 19, 20, 21, and 22, there is shown another or sixth embodiment of a support structure 510 for holding items upright.

The support structure 510 comprises a first peripheral side wall structure 512A and a second peripheral wall structure 512B. The top edge 514A of the first peripheral side wall structure 512A defines an open top 516A and the bottom edge 518A of the first peripheral side wall structure 512A defines an open bottom 520A. Likewise, the top edge 514B of the second peripheral side wall structure 512B defines an open top 516B and the bottom edge 518B of the second peripheral side wall structure 512B defines an open bottom 520B. The first peripheral side wall structure 512A and second peripheral side wall structure 512B are separate elements of the container 510 and are secured together as will be hereinafter discussed. In the unfolded or in-use configuration (see FIGS. 18 and 19), the first peripheral side wall structures 512A and 512B are each generally rectangular in peripheral configuration. The first peripheral side wall structure 512A has a first side wall 524A, a second side wall 526A generally perpendicular to the first side wall 524A, a third side wall 528A opposite and parallel to the first side wall 524A, and a fourth side wall 530A opposite and parallel to the second side wall 526A which side walls cooperate to define a first item-receiving compartment 546. The second peripheral side wall structure 512B has a first side wall 524B, a second side wall 526B generally perpendicular to the first side wall 524B, a third side wall 528B opposite and parallel to the first side wall 524B, and a fourth side wall 530B opposite and parallel to the second side wall 526B which side walls cooperate to define a second item-receiving compartment 548. With regard to the first peripheral side wall structure 512A, the juncture of the first side wall 524A and second side wall 526A forms a first corner 536A, the juncture of the second side wall 526A and third side wall 528A forms a second corner 538A, the juncture of the third side wall 528A and fourth side wall 530A form a third corner 540A and the juncture of the fourth side wall 530A and first side wall 524A forms a fourth corner 542A. Similarly, with regard to the second peripheral side wall structure 512B, the juncture of the first side wall 524B and second side wall 526B forms a first corner 536B, the juncture of the second side wall 526B and third side wall 528B forms a second corner 538B, the juncture of the third side wall 528B and fourth side wall 530B forms a third corner 540B, and the juncture of the fourth side wall 530B and first side wall 524B forms a fourth corner 542B. Each of the four corners 536A, 538A, 540A, and 542A of the first peripheral side wall structure 512A defines a hinge joint so that the side walls 524A, 526A, 528A, 530A can be folded relative to each other about the four corners. Each of the four corners 536B, 538B, 540B and 542B of the second peripheral side wall structure 512B defines a hinge joint so that the side walls 524B, 526B, 528B, 530B can be folded relative to each other about the four corners. The first peripheral side wall structure 512A and second peripheral side structure 512B are disposed in side-by-side juxtaposition with the fourth side wall 530A of the first peripheral side wall structure 512A attached to the fourth side wall 530A of the second peripheral side wall structure 512B and are removably attached to each other by attachment means. Toward this objective, the attachment means comprises a first slit 554 and a second slit 556 formed in the first peripheral side wall structure 512A, and a third slit 558 and a fourth slit 560 formed in the second peripheral side wall structure 512B. With reference to the first peripheral side wall structure 512A (FIG. 20), the first slit 554 is formed in the first peripheral side wall structure 512A at the juncture of the first side wall 524A, and fourth side wall 530A, and the second slit 556 is formed in the first peripheral side wall structure 512A at the juncture of the third side wall 528A and fourth side wall 530A. Each of the slits 554 and 556 are open to the top edge 514A of the first peripheral side wall structure 512A and extend a distance of at least one-half the height dimension of the first peripheral side wall structure 512A. With reference to the second peripheral side wall structure 512B (FIG. 21), the third slit 558 is formed in the second peripheral side wall structure 512B at the juncture of the first side wall 524B and fourth side wall 530B, and the fourth slit 560 is formed in the second peripheral side wall structure 512B at the juncture of the third side wall 528B and the fourth side wall 530B. Each of the slits 558 and 560 are open to the bottom edge 518B of the second peripheral side wall structure 512B and extend a distance of at least one-half of the height dimension of the second peripheral side wall structure 512B. It should be noted here that the first peripheral side wall 512A and second peripheral side wall 512B are identical in size and configuration, and when the first peripheral side wall structure 519A and second peripheral side wall structure 512B are positioned in mutual juxtaposition to be attached together, the second peripheral side wall structure 512B is merely turned upside down relative to the identical first peripheral side wall structure 512A.

Figure 18:
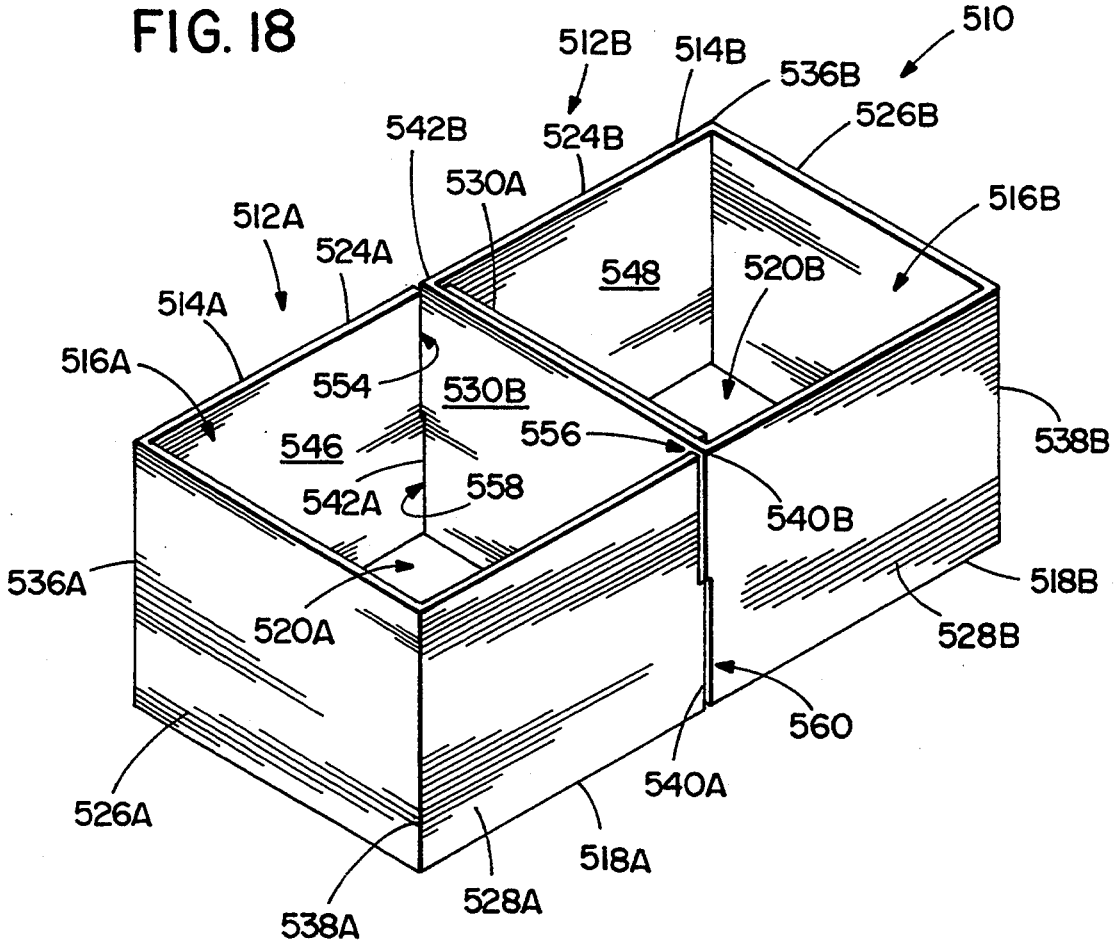
FIG. 18 is a perspective view of still a further embodiment of a support structure of the present invention in an unfolded in-use configuration.
Figure 19:
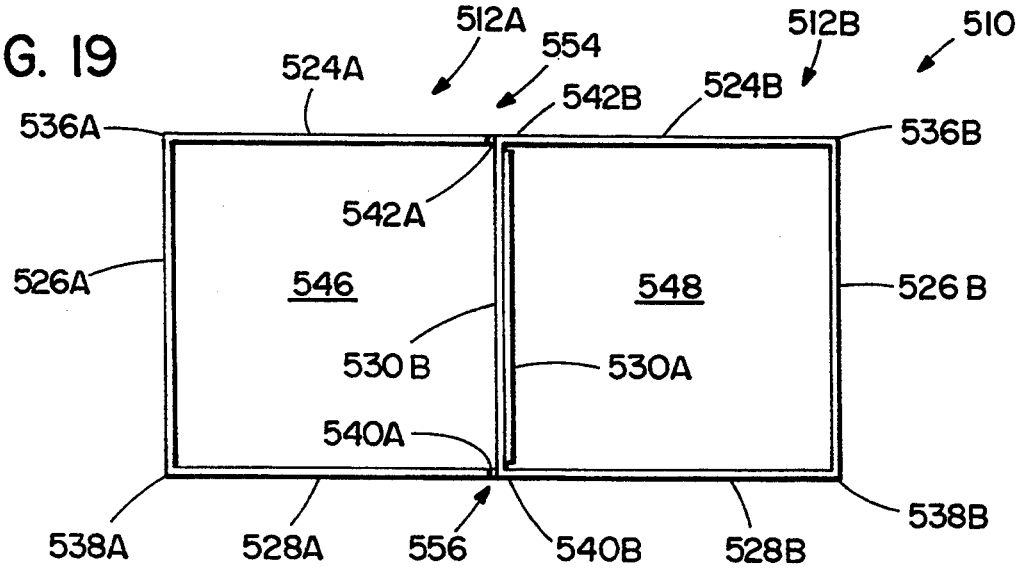
FIG. 19 is a top view of the support structure of FIG. 18.
Figure 21:
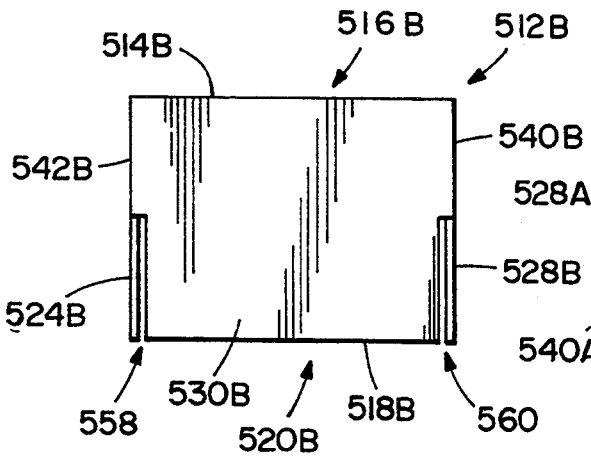
FIG. 21 is an end view of another component of the support structure of FIG. 18; and, FIG. 22 is a side view of the support structure of FIG. 18 in a folded flat configuration for storage.
Figure 20:
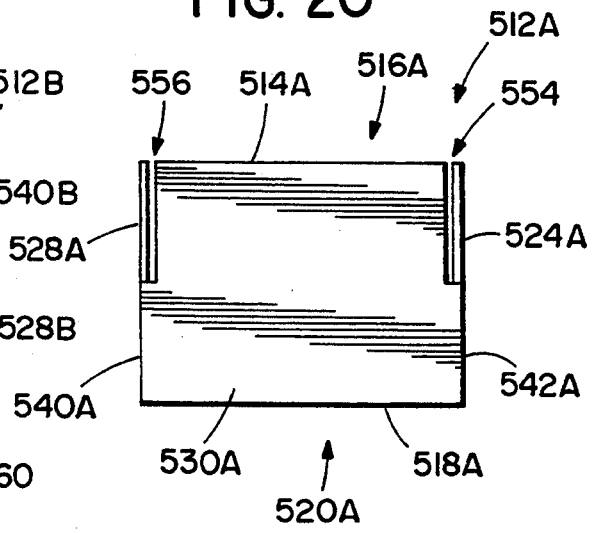
FIG. 20 is an end view of a component of the support structure of FIG. 18.

FIGS. 18 and 19 illustrate the support structure 510 in the in-use unfolded and assembled configuration for receiving bags in the item-receiving compartments 546, 548. The peripheral side wall structure 510 defining the first bag compartment 546 is formed by unfolding the first side wall 524A, second side wall 526A, third side wall 528A and fourth side wall 530A are unfolded about the hinge joints at the four corners 536A, 538A, 540A and 542A to form the generally rectangular configured first peripheral side wall structure 512A. Likewise, the second peripheral side wall structure 512B defining the second bag-receiving compartment 548 is formed by unfolding the first side wall 548B, second side wall 526B, third side wall 528B and fourth side wall 530B about the hinge joints at the four corners 536B, 538B, 540B, 542B form the generally rectangular configurated second peripheral side wall structure 512B. When the first peripheral side wall structure 512A is secured to the second peripheral side wall structure 512B, the corner 542A at the juncture of the first side wall 524A and fourth side wall 530A at the end of the first slit 554 of the first peripheral side wall structure 512A is received in the third slit 558 of the second side wall structure 512B, the corner 540A at the juncture of the third side wall 528A and the fourth side wall 530A at the end of the second slit 556 is received in the fourth slit 560 of the second side wall structure 512B, the corner 542B at the juncture of the first side wall 524B and fourth side wall 530B at the end of the third slit 558 of the second peripheral side wall structure 512B is received in the first slit 554 of the first side wall structure 512A, and the corner 540B at the juncture of the third side wall 528B and fourth side wall 530B at the end of the slit 560 of the second peripheral side wall structure 512B is received in the second slit 556 of the first peripheral side wall structure 512A so that the fourth side wall 530A of the first peripheral side wall structure 512A and the fourth side wall 530B of the second peripheral side wall structure 512B mutually overlap and, thereby, interlock.

Figure 22:
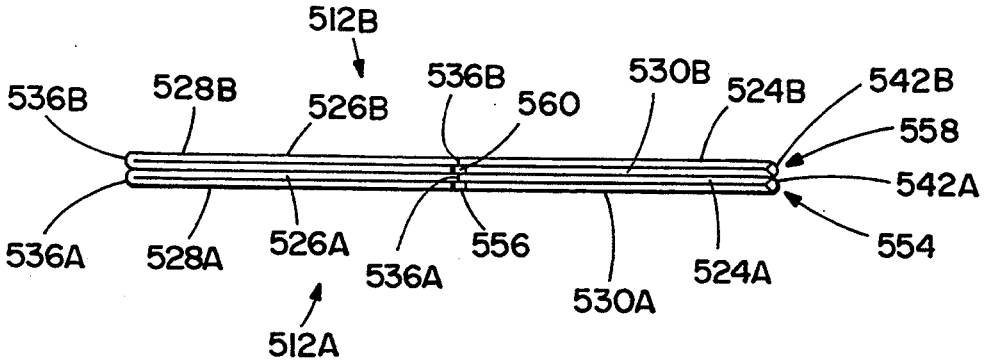

FIG. 22 illustrates the support structure 510 in the storable folded and disassembled configuration, wherein the first peripheral wall structure 512A and second peripheral wall structure 512B are separated from each other. In the storable configuration of the first peripheral side wall structure 512A, the first side wall 524A, second side wall 526A, third side wall 528A and fourth side wall 530A are folded about the hinge joints at the fourth corners 536A, 538A, 540A, 542A so that the first side wall 524A and second side wall 526A are generally coplanar, so the third side wall 528A and fourth side wall 530A are generally coplanar, and the coplanar first and second side walls are in overlaying side-by-side juxtaposition to the coplanar third and fourth side walls to form a thin first stack 562A. In the storable configuration, the second peripheral side wall structure 512B, the first side wall 528B, second side wall 526B, third side wall 528B and fourth side wall 530B are folded about the hinge joints at the four corners 536B, 538B, 540B, 542B so that the first side wall 524B and second side wall 526B are generally coplanar, so the third side wall 528B and fourth side wall 530B are generally coplanar, and the coplanar first and second side walls are in overlaying side-by-side juxtaposition to the coplanar third and fourth side walls to form a thin second stack 562B. Also, the folded flat first stack 562A and folded flat second stack 362B can then be located one upon the other and secured together by, for example, a rubber band.

The foregoing detailed description is given primarily for clearness of understanding and no unnecessary limitations are to be understood therefrom for modifications will become obvious to those skilled in the art upon reading this disclosure and may be made without departing from the scope of the inventions or scope of the appended claims.

I claim:

1. A support structure for supporting bags of groceries in position comprising:

a. a first grocery bag receiving compartment defined by a first rectangular peripheral side wall structure with a flapless open top and a flapless open bottom;

b. a second grocery bag receiving compartment defined by a second rectangular peripheral side wall structure having a flapless open top and a flapless open bottom; said compartments being hingably joined to each other only along a single axis about which said compartments can be rotationally displaced relative to one another, each of the corners of said compartments being hingable such that said compartments are collapsible against each other to form a flattened package for storage purposes, said wall structures being formed of a single and unitary sheet of material.

2. A support structure for supporting bags of groceries in position comprising a pair of fully separate and distinct grocery bag receiving compartments, said compartments being open and flapless on upper and lower ends thereof and being essentially rectangularly shaped when in an operative, grocery bag receiving condition, said compartments having a connection to each other only along a single corner of each of said pair, said connection being a single hingable axis to permit changing the orientation of said compartments relative to each other in a plane perpendicular to said axis, said compartments each including four peripheral side walls which are hingably connected to one another successively such that said compartments can be collapsed against one another into a flattened package for storage purposes.

3. The support structure of claim 2 further comprising vertical fold lines formed in the side walls generally parallel the to the corners of said containers defining joint lines about which the side walls can bulge outwardly.

4. The support structure of claim 2 wherein said pair of compartments if formed of a single and unitary sheet of material, said sheet comprising eight rectangularly shaped and successively joined panels which form said side walls.

5. The support structure of claim 4 wherein one end portion of said sheet is hingably connected to a fourth one of said side walls, counting said side walls from said one end portion, immediately adjacent to a hinge connection between said fourth and a fifth one of said side walls, and wherein the other end portion of said sheet is hingably connected to said fifth one of said side walls immediately adjacent the hinge connection between said fourth and fifth side walls.

6. The support structure of claim 4 wherein said hingable connection between said containers and the joints between said successively joined panels are fold lines.

7. The support structure of claim 2 wherein said side walls are constructed of a material selected from the group consisting of cardboard and corrugated plastic.

8. The support structure of claim 2 wherein two opposing ones of the side walls of at least one of said containers have equal peripheral lengths, as measured perpendicular to said connection, which are different from corresponding equal lengths of the other two opposing ones of the side walls of the same one of said containers.

9. A support structure for supporting bags containing groceries or other articles in an upright position comprising a unitary sheet containing a series of eight panels integrally and foldably connected successively to one another, opposite end portions of said sheet being foldably connected along side a foldable connection forming a single axis between a fourth and fifth one of said panels as counted from either end of the panels contained in said sheet, said sheet forming two rectangularly shaped containers open on upper and lower ends thereof when said containers are disposed in an operative, grocery bag receiving condition, said open ends being flapless, said containers being alignable in an angularly disposed relationship about said axis wherein said two containers abut one another along only said foldable connection and, in the alternative, in a side-by-side relationship at the option of a user, said two containers being foldable at the foldable connection between them and along the corners thereof against one another to form a flattened package for storage purposes.

10. The support structure of claim 9 wherein said sheet is constructed of a material selected from the group consisting of cardboard and corrugated plastic.

* * * * *